United States Patent [19]

Boschet

[11] 4,026,242

[45] May 31, 1977

[54] MATRIX SUPPORTING DEVICE IN ELECTROSTATIC DEVELOPMENT APPARATUS

[75] Inventor: Vittorio Boschet, Milan, Italy

[73] Assignee: Grafosol S.p.A., Milan, Italy

[22] Filed: June 2, 1975

[21] Appl. No.: 582,615

[30] Foreign Application Priority Data

June 28, 1974 Italy ..... 24540/74

[52] U.S. Cl. ..... 118/657; 118/503; 271/277

[51] Int. Cl.[2] ..... G03G 15/09

[58] Field of Search ..... 118/637, 231, 503; 427/14, 18; 271/277; 101/132.5

[56] References Cited

UNITED STATES PATENTS

| | | | |
|---|---|---|---|
| 2,234,973 | 3/1941 | Marchev | 118/231 |
| 3,196,767 | 7/1965 | Eichorn | 271/277 X |
| 3,544,097 | 12/1970 | Linden | 271/277 X |
| 3,567,213 | 3/1971 | Lagonegro et al. | 271/277 X |
| 3,728,987 | 4/1973 | Kronseder | 118/231 |
| 3,734,015 | 5/1973 | Camis et al. | 271/277 X |
| 3,764,208 | 10/1973 | Takahashi et al. | 118/637 X |
| 3,788,275 | 1/1974 | Hanson | 118/637 |
| 3,858,869 | 1/1975 | Campbell et al. | 118/231 |

*Primary Examiner*—Mervin Stein

[57] ABSTRACT

A matrix supporting device in electrostatic developing apparatus, wherein the matrix is moved to a position in front of the magnetic developing roller while adhering to a rotable cylindrical surface, the axis of rotation of which is at a fixed spacing from that of the roller.

5 Claims, 4 Drawing Figures

MATRIX SUPPORTING DEVICE IN ELECTROSTATIC DEVELOPMENT APPARATUS

This invention relates to a device for holding a previously exposed matrix in correct position as the latent image is electrostatically developed.

The electrostatic method for transferring an original text or the like to a printing matrix is well known; such a method consists of electrostatically charging a matrix, exposing the matrix so that a latent image of the original is formed thereon, developing the image by applying a toner to the matrix, and fixing such a toner by baking.

In conventional apparatus the development step is carried out by dipping the matrix in a toner bed, or by applying said toner by means of a magnetic cylinder drawing it from a tray. In both cases, the matrix is held along its longitudinal edges by clamps or the like. These approaches or embodiments have the disadvantage that toner distribution at exposed areas cannot be quite satisfactory, either because of coarseness in the dipping method, or because of changeability in distance between magnetic roller and matrix, which changeability is due to the means (such as clamps) used for supporting the matrix.

This invention proposes an approach to the problem relating to the quality of the image being developed on the matrix by providing that the matrix should be brought in front of the magnetic toner transferring roller while adhering to a rotable cylindrical surface, the axis of rotation of which is at a fixed distance or spacing from that of the magnetic roller.

The invention will be more clearly understood from the following detailed description of a preferred embodiment thereof as given by mere way of unrestrictive example, reference being had to the accompanying drawings, in which.

Figure 1:
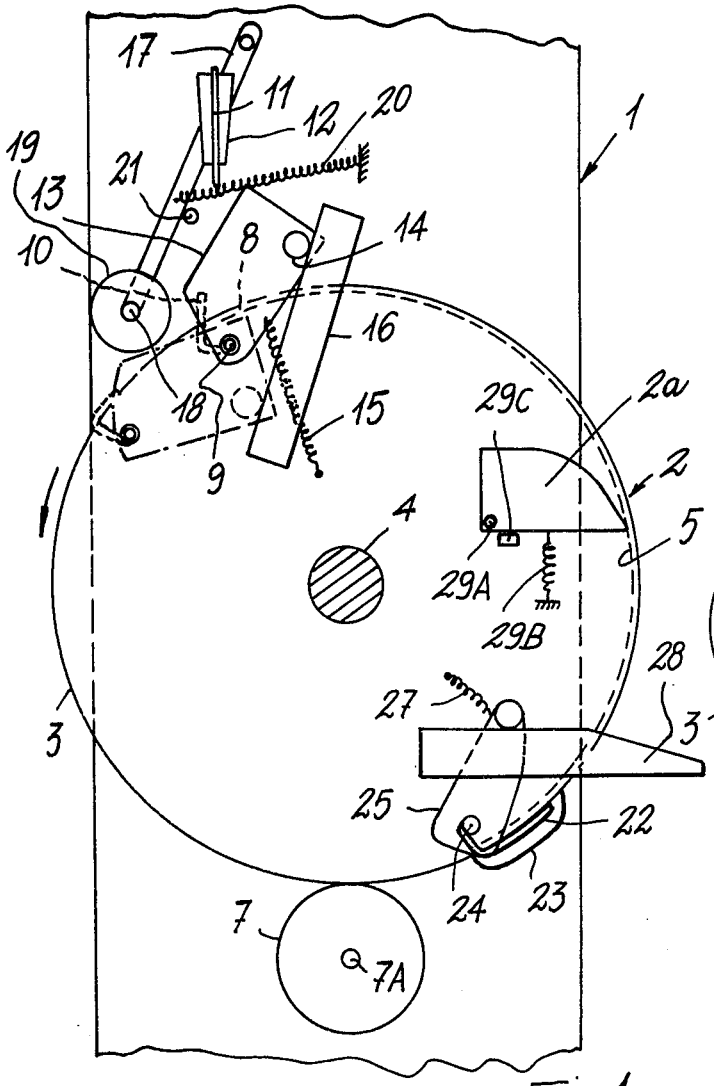
FIG. 1 is a schematic side view showing the device in accordance with the invention, following removal of one of the supporting uprights and having all of the cams shown on a same side.
Figure 2:
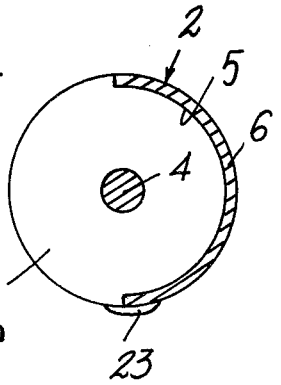
FIG. 2 is a view showing a substantially semicylindrical body to which the matrix is adhered.

Referring to the drawings, a device according to the invention comprises a pair of parallel spaced apart uprights 1 supporting a shaft 4 having a body 2 rotably carried thereon, this body being formed of two circular heads 3 and a substantially semicylindrical skirt 5. Body 2 is coated with insulating paint, and at its central area, said skirt 5 is electrically conductive. This conductive area or zone is designated at 6.

Below said body 2, provision is made for a per se known type of magnetic roller 7 for transferring the toner from a tray to the matrix. Through any type of known drive means, roller 7 is rotatably controlled about its axis 7A which is at a fixed spacing from shaft 4. Even during operation, said roller 7 will not contact the surface of skirt 5 or the matrix, but is retained at a predetermined distance therefrom, so as to provide for optimum application of the toner.

Body 2 is also operated by drive means controllable, for example, by switches.

Adjacent the forward or front edge 8 of skirt 5 and between the end discs 3, provision is made for rotatably carrying a shaft 9 having a bell-crank blade clamp 10 secured thereto, the function of which is to clamp against said edge 8 the forward end of matrix 11 to be developed the latter falling down through guide channel 12.

On the portion of shaft 9 projecting beyond one of said discs 3, a cam 13 is secured and has a roller 14 and a return spring 15. At the initial or starting position (i.e. that position shown by full lines in FIG. 1), the above mentioned roller 14 presses against a cam 16 secured to one of said uprights 1, holding the clamp 10 at the opening position shown in FIG. 1.

At the free ends of a pair of arms 17 (pivoted to uprights 1) a rotatable shaft 18 is carried and has rubber rollers 19 mounted thereon. A spring 20 is provided for urging counterclockwise rotation of the device, whereas under inoperative conditions the device is held against a stop 21. The purpose of roller 19 is to press matrix 11 against skirt 5. In order to prevent rubber rollers 19, which contact the front and rear clamps 10 and 22, from becoming soiled and in turn smear said matrix 11, it is provided that: (a) during the first stage of movement for body 2, cam 13 will cause such a lifting of rollers 19 that these rollers are stepped over the front clamp 10 and away from-body 2, and (b) a cam 23 secured to one of said discs 3 can cause said rollers 19 to be lifted during the final stage of movement upon passage of rear clamp 22.

Rear clamp 22 is also mounted as front clamp 10, that is on a rotatable shaft 24. On the projecting portion of this shaft, a cam 25 provided with a roller 26 and a return spring 27 is mounted.

This cam 25, as well as fixed cam 28 cooperating therewith, are located on that side of body drum 2 which is at opposite position relative to that where cams 16, 21 and also 2*a* are located. This last mentioned cam 2*a* is pivoted at 29A to one of said uprights 1, is maintained by a spring 29B against a stop 29C, and operates to open the front clamp 10 following matrix development. A fixed cam 30 (see FIG. 3) cooperates with the rear clamp 22 for causing opening thereof.

The clamps 10 and 22 may be painted with a non-conductive material if desired.

The operation of the above described mechanism is as follows:

The initial or starting position is that as shown in FIG. 1. On moving down along conduit 12, the exposed but not developed matrix 11 actuates a switch which in turn energizes an actuator rotatably counterclockwise driving said drum 2 (see arrow in FIG. 1). As this operation takes place, the front edge of the matrix is already at a preset position for clamping between said clamp 10 and edge 8 of skirt 5.

Upon movement of said drum, roller 14 runs or slides on fixed cam 16, thereby closing the front clamp (as shown by dash- and dot-lines in FIG. 1) and causing the closed clamp 10 to be stepped over by the rubber rollers 19, the latter being applied to and pressing and smoothing the matrix against the skirt or wall 5.

Figure 3:
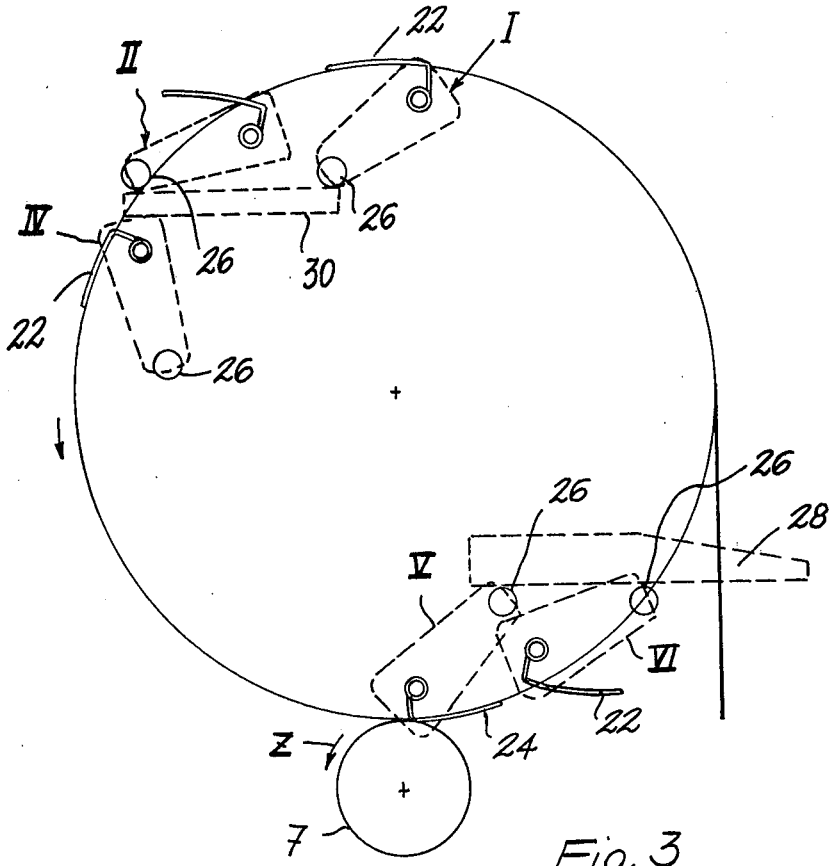
FIGS. 3 and 4 are also schematic views showing on the same side and at various positions some of the device cams.

When the rear clamp 22 reaches the position I shown in FIG. 3, the associated roller 26 by cooperating with cam 30 will open the clamp (position II) and after leaving said cam will close (position IV) on the rear edge of the matrix, the front edge of which already lies at the exposure area, that is at the zone of developing roller 7, the latter rotating in the direction shown by arrow Z. The start for the latter can be controlled by a contactor which is actuated when drum 2 has rotated to move the front edge of the matrix in proximity to said developing roller 7.

When the rear edge of the matrix has also passed said roller or cylinder 7, roller 26 becomes engaged with cam 28, causing the opening of the rear clamp 22 (see positions V and VI of FIG. 3) and the stopping of drum 2. When the rear clamps 22 reaches the position V by the intermediary of a switch, roller or cylinder 7 is stopped. Upon motion stopping of drum 2, a motion in opposite direction is then effected.

Upon opening of the rear clamp 22, the matrix is clear or free at its tail or rear portion and takes the attitute as substantially shown by thick dash lines in FIG. 3.

Figure 4:
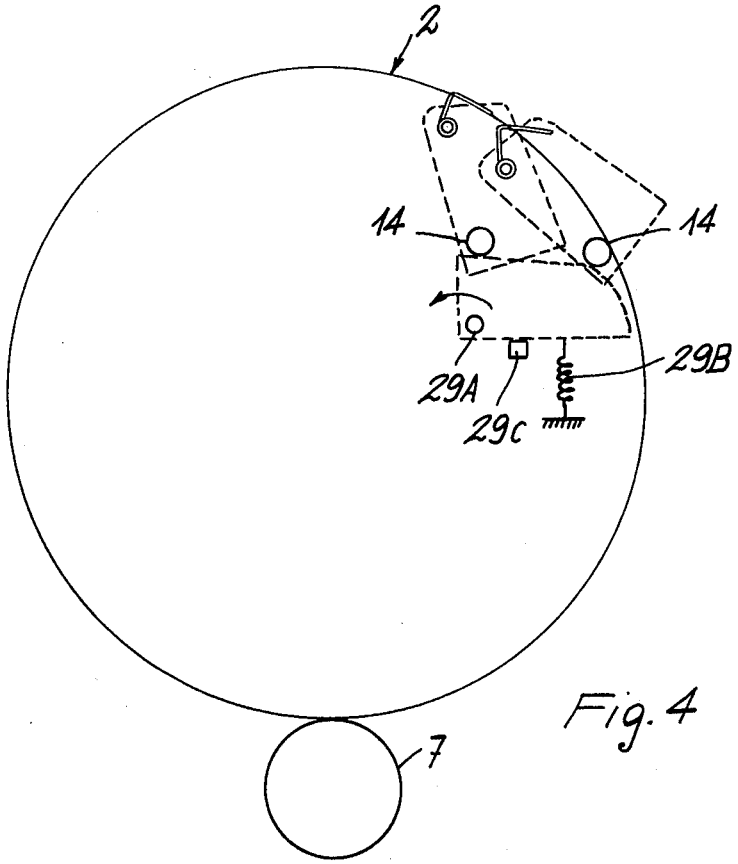

The return stroke is terminated at the position shown in FIG. 4 by the action of a switch. The front clamp 10, which had displaced cam 2*a* by the action of roller 14, during the counterclockwise rotation of the drum, is now open, due to the action of the back of cam 2*a* inhibited from rotating clockwise by stop 29*c*. Therefore, the released matrix will fall down, and further means, not shown, but not forming the subject of the present invention, will provide for its next processing.

Although only one embodiment of the invention has been shown and described, those skilled in the art can now readily devise many changes and modifications which, however, should all be intended as within the scope of the invention.

What is claimed is:

1. A matrix supporting device in an electrostatic developing apparatus, comprising:

a magnetic developing roller for applying toner to the exposed surface of said matrix:

means defining a rotatable cylindrical surface; and means for spacing the axis of rotation of said cylindrical surface at a fixed spacing from that of said roller; and wherein said means defining a rotatable cylindrical surface includes:

a cylindrical skirt portion for receiving said matrix; and a pair of rocker clamps for releasably clamping the leading and trailing edges of said matrix at the outer circumferentially spaced edges of said skirt portion; and said device further comprising:

means for pressing said matrix against said cylindrical skirt; and means for stepping said pressing means over said clamps as said skirt rotates.

2. A device as claimed in claim 1, wherein said means defining a rotatable cylindrical surface is a cylindrical drum having a disc shaped head closing each end of said cylindrical surface.

3. A device as set forth in claim 1, wherein said skirt portion and heads are coated with an insulating material, except for an intermediate skirt strip which is specular.

4. A device as set forth in claim 1, wherein said clamps are coated with an insulating material.

5. A device as set forth in claim 1, wherein the movement of said clamps is controlled by cam means.

* * * * *